United States Patent [19]

Huggins

[11] Patent Number: 4,714,432

[45] Date of Patent: Dec. 22, 1987

[54] HERMETIC SEAL FOR ELECTRICAL COAXIAL CONNECTOR

[75] Inventor: Richard A. Huggins, Islip Terrace, N.Y.

[73] Assignee: Automatic Connector, Inc., Commack, N.Y.

[21] Appl. No.: 804,921

[22] Filed: Dec. 5, 1985

[51] Int. Cl.[4] ..... H01R 13/52

[52] U.S. Cl. ..... 439/271; 439/578

[58] Field of Search ..... 339/177, 218, 275 R, 339/94 R, 94 M; 427/54.1; 264/262

[56] References Cited

U.S. PATENT DOCUMENTS

| | | | |
|---|---|---|---|
| 3,113,284 | 12/1963 | Inthoudt | 264/262 |
| 3,292,117 | 12/1966 | Bryant et al. | 339/177 R |
| 3,328,512 | 6/1967 | Lembke et al. | 264/262 |
| 4,415,604 | 11/1983 | Nativi | 427/54.1 |
| 4,420,210 | 12/1983 | Karol et al. | 339/94 M |
| 4,445,744 | 1/1984 | Sedig et al. | 339/94 M |
| 4,603,023 | 7/1986 | Mack et al. | 264/262 |

*Primary Examiner*—Gil Weidenfeld
*Assistant Examiner*—David Pirlot
*Attorney, Agent, or Firm*—Peter L. Berger

[57] ABSTRACT

A hermetic seal is formed of a compound which is applied with low viscosity to a form located between a center contact and a body of a coaxial connector. The compound is cured without heat or pressure by subjecting it to ultraviolet light. The viscous material completely seals the coaxial connector and when hardened forming an excellent hermetic seal. Apparatus for holding the coaxial connectors vertical to receive the compound is also disclosed.

10 Claims, 3 Drawing Figures

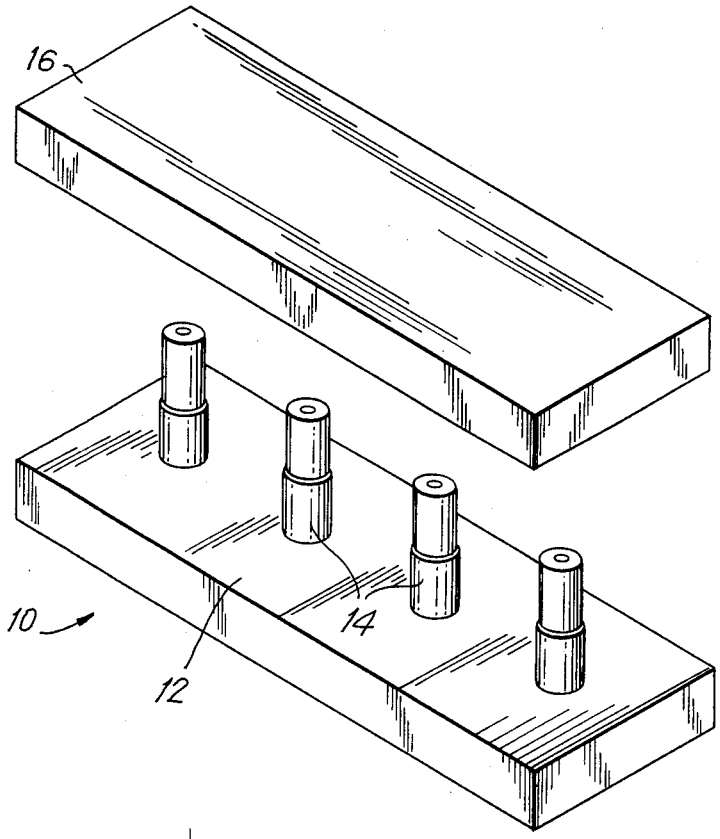
FIG. 1
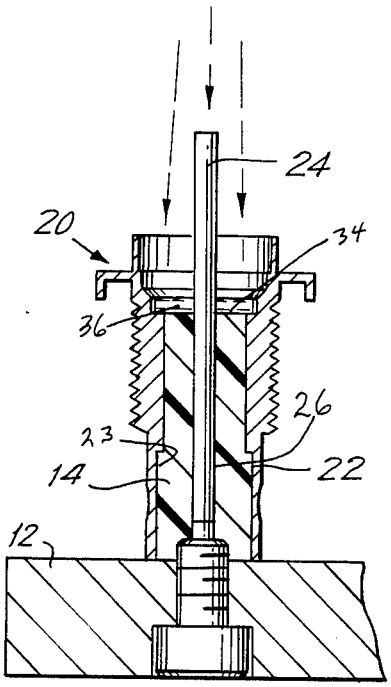
FIG. 3
FIG. 2
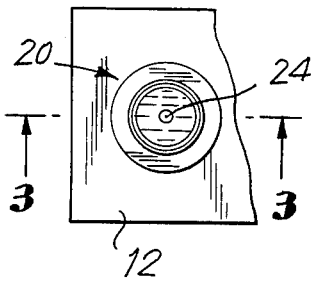

HERMETIC SEAL FOR ELECTRICAL COAXIAL CONNECTOR

BACKGROUND OF THE INVENTION

This invention relates to hermetic sealing the ends of electrical coaxial connectors, and more particularly, to a sealing process which is more economical.

Glass type seals are the most common type hermetic seal employed for coaxial connectors. The patent to D. F. Rundle U.S. Pat. No. 3,371,413 illustrates such prior glass hermetic seals. They generally comprise an axial pin bonded to and surrounded by a disc-shaped glass body which itself is bonded to and attached to a circular metal ring. A hermetic seal is formed between the three elements. In many applications, the glass seal element is then plated. A plated contact is then soldered to each end of the pin, and the completed assembly is then soldered into the body. This is accomplished by heating the body and inserting the assembly. During this soldering operation, the plating may discolor or peal, and this is unacceptable. Additionally, in the fabrication of such connectors for special specifications, inspection may be required at each step. As may readily be understood, the assembly of such hermetically sealed connectors is time consuming, labor intensive and expensive.

Recently, Loctite Corporation developed and introduced a compound which serves as an insulator and may be cured by ultraviolet light. Loctite has received several patents for these compounds and the following list is merely representative:

U.S. Pat. No. 4,415,604, L. Nativi, Nov. 15, 1983; U.S. Pat. No. 4,439,600, James Moran, Mar. 27, 1984; U.S. Pat. No. 4,477,326, S. Lin, Oct. 16, 1984; U.S. Pat. No. 4,503,208, S. Lin et al., Mar. 5, 1985.

The use of a suitable material for forming a sealed end for an insulated conductor is shown in U.S. Pat. No. 4,301,325 issued to J. B. Hutchinson entitled Sealing Conduits. This patent illustrates surrounding the end of an insulated conductor with a viscous material while it is pasty and applying pressure to the material causing it to flow and form a sealing body in peripherally continuous contact with the insulated conductor. This patent bears no relation to providing hermetic seals.

An object of this invention is to provide a less expensive hermetic seal.

Another object of this invention is to provide a method of forming hermetic seals which is easy, non-labor intensive, relatively foolproof and adaptable to production techniques.

Still another object of this invention is to provide such a hermetic seal which reduces the number of parts required.

Yet another object of this invention is to provide a process for forming said hermetic seals which lends itself to automation.

Still another object of this invention is to form such a hermetic seal without heat or pressure.

Other objects, advantages and features of this invention will become more apparent from the following description.

SUMMARY OF THE INVENTION

In accordance with the principles of this invention, the above objects are accomplished by providing a coaxial connector in which the region between the center contact and the outer conductor is filled with a compound which is curable with ultraviolet light. This material when it sets forms an insulator and provides a hermetic seal. The material is of a low viscosity, and a form is configured for the connector allowing the compound to be dropped into and held in the region between the center contact and outer conductor. The material is self-leveling and when dropped in the receptacle formed in the end of the insulator between the center and outer contacts, it will be retained. This assembly is then passed through an ultraviolet source to cure. Once cured, the material hardens and forms the hermmetic seal.

BRIEF DESCRIPTION OF THE DRAWINGS

FIG. 1 is a perspective view of a holder for a plurality of electrical connectors whose ends are to be hermetially sealed.

FIG. 2 is a top plan view of the connector mounted on a holder or post.

FIG. 3 is a cross-sectional view take along lines 2—2 of FIG. 2 illustrating the sealing operation of this invention.

DETAILED DESCRIPTION

FIG. 1 illustrates an assembly which permits automation of the hermetic seals for coaxial connectors. In particular, the assembly 10 is illustrated comprising a rigid base 12 on which there are mounted a plurality of cylindrical holders 14. These holders are sized to frictionally receive and hold coaxial connectors in a vertical position. Ultraviolet source 16 irradiates the plurality of aligned holders 14 which will receive and hold a corresponding number of coaxial connectors. Base 12 is illustrative, and for full automation, a movable carrier having mounted holders such as 14 could be provided where the carrier takes the form of a movable belt or trolley.

FIGS. 2 and 3 illustrate one station which comprises the holder 14 frictionally holding a connector 20. Connector 20 has a body 22 which has a hollow central portion with a lower portion 23 substantially conforming to the shape of cylindrical holder 14. The connector comprises a center contact 24 the bottom of which fits into an axial receptacle 26 in holder 14.

An annular form 34 is formed between contact center 24 and body 22 into which an ultraviolet curing compound 36 is dropped. It falls onto the front surface of post or holders 14 and fills the form between the body 22 and center contact 24 in the annular form 34. The viscosity of the compound is low so that it freely flows to completely fill all interstices and seals the space between body 22 and center contact 24. The low viscosity of the material enables it to be self-leveling, and sufficient material is supplied to fill the form 34. The form 4 also holds the compound in place, and when the connector passes under the ultraviolet light, it cures and hardens. In this state, the compound hermetically seals the end of the connector. This is accomplished without heat or pressure, and the avoidance of heat or pressure also eliminates the problems which surface when these processes are used for high quality coaxial connectors.

As may be readily understood, maintaining the form 34 vertical enables the compound to become self filling and self-leveling. This accuracy in completely filling the form eliminates many time consuming and expensive steps of the prior art as well as the numerous inspections for each step. Further, this invention eliminates the need for the glass seal as well as the metal ring surrounding said seal.

This invention has been described with reference to a preferred embodiment. Numerous modifications may be made by those skilled in the art, yet such modification will fall within the scope of protection of this invention.

What is claimed is:

1. A method for forming a hermetic seal without using a glass seal for a coaxial connector which comprises a center contact surrounded by a body, a form configured between said center contact and said body, said non-glass hermetic seal being located in said form, said method comprising the steps of:

assembling said center contact, said body and a holder as one unit to provide said form between said center contact and said body, vertically holding said unit on said holder, forming said non-glass hermetic seal by the steps of applying a material consisting essentially of a light curable viscous chemical compound to fill the form between said center contact and said body, and supplying light to said compound to cure said viscous chemical compound and thereby form said non-glass hermetic seal effectively only by said light cured compound.

2. A method for forming a hermetic seal as set forth in claim 1, further comprising the step of self-leveling said compound in said form before curing the same.

3. A method for forming a hermetic seal as set forth in claim 1, further comprising the step of forming a well in said form into which said viscous compound is dropped and completely filling said form and curing said compound therein.

4. A method for forming a hermetic seal as set forth in claim 3, further comprising the step of self-leveling said compound in said form before curing the same.

5. A method for forming a hermetic seal as set forth in claim 1, further comprising applying an ultraviolet light to said compound to cure said compound.

6. A method for forming a hermetic seal as set forth in claim 5, further comprising the step of self-leveling said compound in said form before curing the same.

7. A method for forming a hermetic seal as set forth in claim 3, wherein said well is formed by forming an annular form in said center contact.

8. A method for forming a hermetic seal as set forth in claim 7, further comprising the step of self-leveling said compound in said form before curing the same.

9. A method for forming a hermetic seal as set forth in claim 1, further comprising a holder for holding a plurality of said coaxial connectors permitting one after another of said coaxial connectors to be filled with said comound.

10. A method for forming a hermetic seal as set forth in claim 9, further comprising the step of self-leveling said compound in said form before curing the same.

* * * * *